US005904267A

United States Patent [19]

Thompson

[11] Patent Number: 5,904,267

[45] Date of Patent: May 18, 1999

[54] NO-ICE COOLER

[76] Inventor: Patrick Thompson, 2328 Burns Ave., Melbourne, Fla. 32935

[21] Appl. No.: 08/877,078

[22] Filed: Jun. 17, 1997

[51] Int. Cl.[6] ..... F17C 3/04

[52] U.S. Cl. ..... 220/592.16; 62/457.3; 215/12.1; 220/23.91

[58] Field of Search ..... 62/457.3, 457.4; 215/12.1, 13.1, 395, 396; 220/592.16, 592.17, 592.27, 23.91

[56] References Cited

U.S. PATENT DOCUMENTS

| | | | |
|---|---|---|---|
| 2,838,194 | 6/1958 | Piker | 220/592.16 |
| 3,308,980 | 3/1967 | Taylor | 215/13.1 |
| 4,281,520 | 8/1981 | Norwood | 62/457.4 |
| 4,580,412 | 4/1986 | Wells | 62/372 |
| 4,798,063 | 1/1989 | Rimmer | 62/457 |
| 4,811,858 | 3/1989 | Augur | 215/13.1 |
| 4,921,141 | 5/1990 | Branum | 222/146.6 |
| 4,931,333 | 6/1990 | Henry | 428/76 |
| 4,986,089 | 1/1991 | Raab | 62/457.4 |
| 5,067,328 | 11/1991 | Medina | 62/457 |
| 5,148,682 | 9/1992 | Wolf | 62/457.3 |
| 5,177,981 | 1/1993 | Haas | 62/457.3 |
| 5,207,076 | 5/1993 | Sciarrillo | 62/457.4 |
| 5,212,963 | 5/1993 | McGinnis | 62/457.4 |
| 5,275,015 | 1/1994 | Brossia | 62/372 |
| 5,406,808 | 4/1995 | Babb | 62/457.4 |
| 5,555,746 | 9/1996 | Thompson | 62/457.4 |

*Primary Examiner*—William E. Tapolcai
*Attorney, Agent, or Firm*—Law Offices of Brian S. Steinberger; Brian S. Steinberger

[57] ABSTRACT

No ice cooler containers for keeping cool the contents of 1 quart through 1 gallon disposable bottles. The containers are formed form molded plastic and can have solid side walls or double co-axial side walls filled with blue ice®, frozen water and the like. Gripping handles can be molded to the side walls of the containers. The upper portions of the containers can include a removable dome top which screws onto a lower base portion. Some containers have the top caps of the disposable bottles protruding therefrom or have an external cup lid that screws onto the dome portion of the container. Another embodiment has an insulated slip cover that screwably attaches directly to the existing threads on disposable bottles. A still another version allows for various diameter neck bottles to be screwed within an insulated slip cover.

10 Claims, 18 Drawing Sheets

Fig. 2B
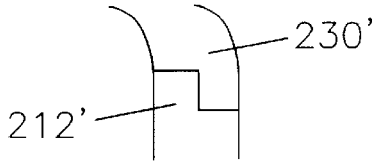
Fig. 2C
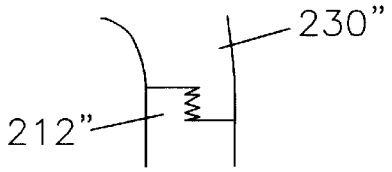
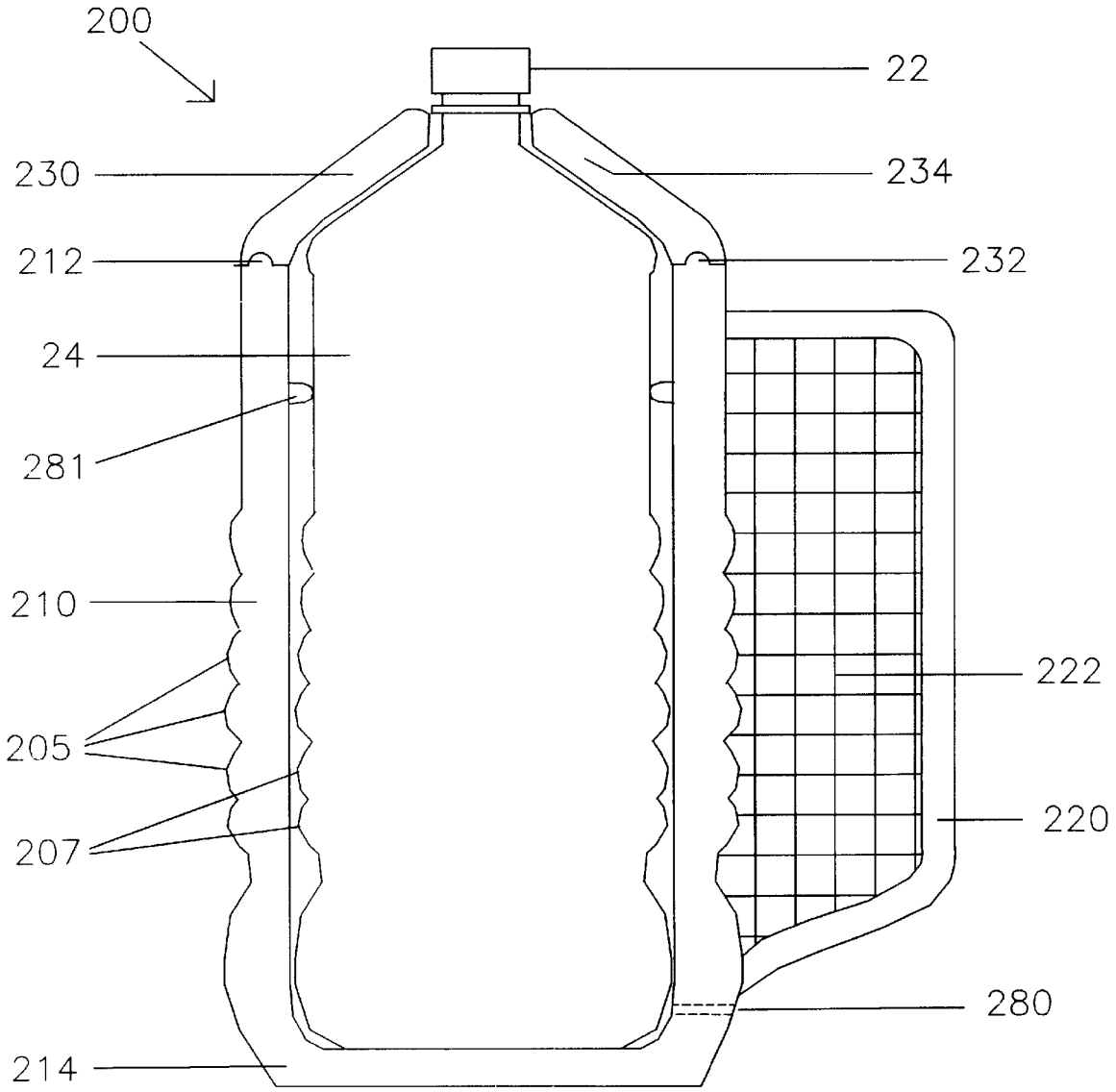
Fig. 2A

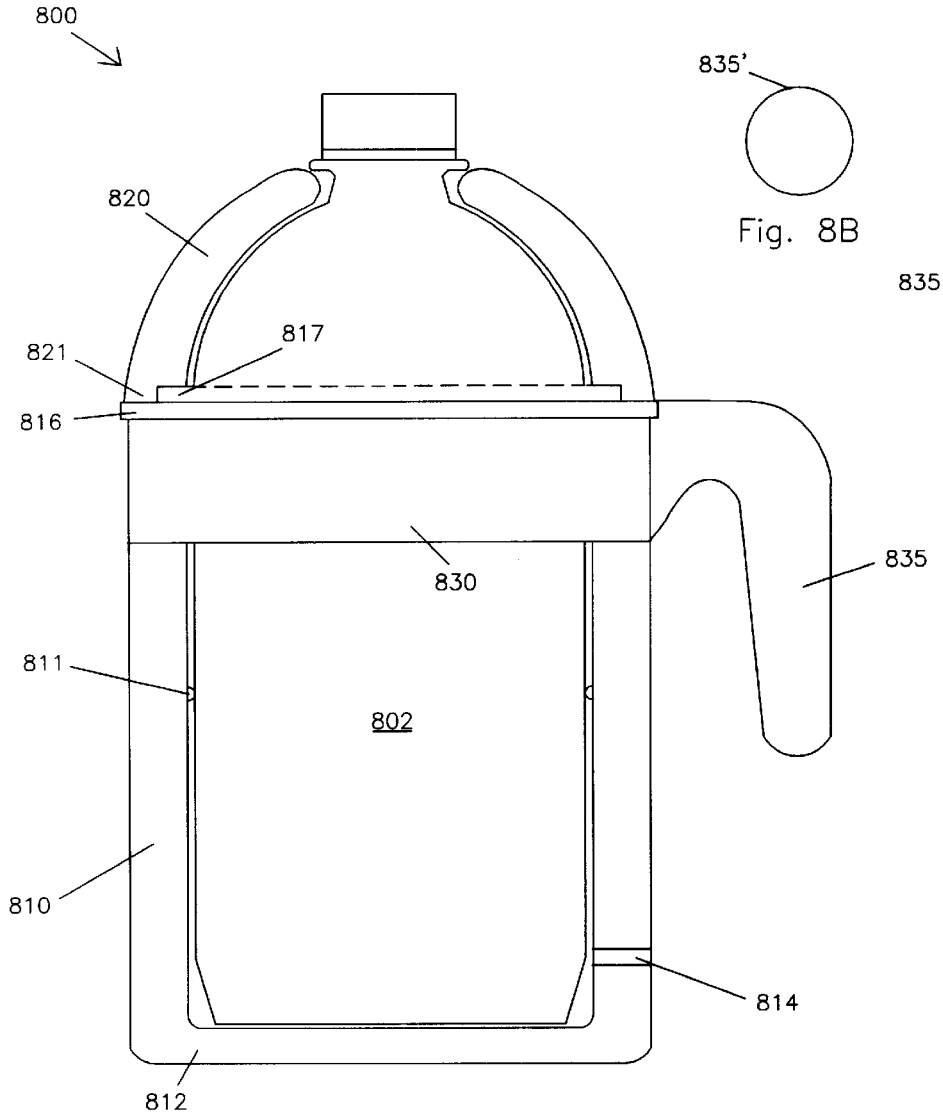
Fig. 8A
Fig. 8B
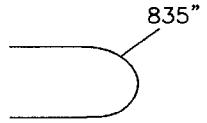
Fig. 8C
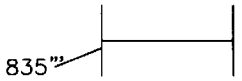
Fig. 8D

NO-ICE COOLER

This invention relates to coolers, and in particular to containers for supporting and for insulating the contents of various sized disposable plastic and glass type bottles. This invention is related to Ser. No. 08/488,789 filed on Jun. 8, 1995, which issued as U.S. Pat. No. 5,555,746 on Sep. 17, 1996, by the same inventor thereof, and which is incorporated by reference.

BACKGROUND AND PRIOR ART

Various sized bottles over 8 ounces or more including one liter, two liter and three liter plastic type bottles are standard and popular containers for holding all types of liquids such as soda pop, seltzer and juices. Because of the extended time it would take to finish off the contents of one of these bottles, the bottles need to be refrigerated for the next use. For example, the normal time needed for a single person to finish off a 2 liter bottle on a hot day would take at least several hours. By the time these 2 liter bottles are half empty, their contents are no longer cold and have become luke warm. The problem is exasperated in warm climate locations in the summer or in climates such as Florida where people work and/or have active lives outdoors. Large block shaped Styrofoam coolers are inadequate for cooling a single 2 liter bottle. Traditional cylindrical type thermoses are also inadequate since the contents of the 2 liter bottle itself would have to be drained into the cylindrical thermos container. Furthermore, using typical plastic type pitchers and filling the contents with ice is also inadequate, because the contents then become watered down. Furthermore, pouring out the contents of the 2 liter bottle can cause the contents to become flat U.S. Pat. No. 5,406,808 to Babb et al. describes an elaborate, difficult to manufacture two-liter bottle cooler/insulator that does not efficiently and effectively hold the contents of two-liter bottles. U.S. Pat. Nos. 4,580,412 to Wells; 4,798,063 to Rimmer; 4,921,141 to Branum; 4,931,333 to Henry; 4,986,089 to Raab; 5,067,328 to Medina et al.; 5,212,963 to McGinnis; 5,207,076 to Sciarrillo; and 5,275,015 to Brossia et al. describe various types of prior art devices that do not solve the above mentioned problems.

Other sizes of bottles such as sport bottles, half liter, one liter, and other large bottles such as those for GATORADE®, POWERADE®, and large mouth PEPSI® 1 liter bottles also have a similar problem where the bottles are both difficult to hold during the day and keep cool during the day. Thus, the need exists for a container for cooling and insulating the contents of various sized bottles.

SUMMARY OF THE INVENTION

The first objective of the present invention is to provide a container for keeping the contents of various sized bottles chilled for extended periods of time.

The second object of this invention is to provide an insulated container cover with a handle for supporting a standard bottle.

The third object of this invention is to provide a container with a removable top which allows a standard bottle to become a pitcher.

The fourth object of this invention is to provide a cooler container for bottles with a removable portion that can be refrigerated prior to use.

The fifth object of this invention is to provide a cooler container wherein the standard screwable top of a disposable bottle can be screwed within the inside of the cooler container.

Multiple embodiments of no-ice coolers are described for keeping the contents of disposable bottles from eight ounce through 1 gallon and ½ liter through 3 liters cold therein without having to pour the bottle contents out.

A first version of the insulated slip cover includes a substantially hollow plastic cylindrical container configured to wrap about the bottle, and a handle such as a downwardly facing lever arm attached to the container for allowing the container to be hand carried. The slip cover can be formed from plastic, styrene double side walls with a hollow space with a pre-freezable liquid therein. Another version has a bottom portion housing a freezable liquid wherein the bottom portion can be attached to and removable from a lower portion of the cylindrical container. The bottom portion could alternatively include a removable disc shape filled with the freezable liquid. A flexible lanyard can also be attached to the container to allow the latter to be shoulder carried by the user.

Another version of the insulated slip cover includes a hollow insulated sleeve having a narrower inwardly sloping top portion to a neck, and a cylindrical lower portion, and an interior cap having interior facing threads within the neck for mateably screwing onto existing exterior threads of a disposable bottle, so that attaching the sleeve to the disposable bottle keeps the contents of the disposable bottle at a substantially constant temperature. This version can include exterior facing threads on the neck for mateably attaching to internal threads on a screwable cap from the disposable bottle. Furthermore, a detachable base can be used for closing a open bottom end of the cylindrical lower portion. Still furthermore, an external raised ring about the exterior face of the neck portion beneath the exterior facing threads and/or a lanyard can be used for allowing a user to hold the insulated slip cover and bottle together. Side handles such as a downwardly angled lever arm handle can be attached to a side of the slip cover to also allow a user to grip the insulated slip cover and bottle together.

A still another version can include a second interior cap having second internal threads located in the neck for allowing the threads on a second disposable bottle to be mateably screwed thereon, where the second disposable bottle exterior threads have a larger diameter than the first disposable bottle exterior threads.

A still another version can include a third exterior cap having third internal threads located in the neck for allowing threads on a third disposable bottle to be mateably screwed thereon, where the third disposable bottle exterior threads have a larger diameter than the second disposable bottle exterior threads. The interior caps can be formed from plastic, styrene and the like. The slip covers can be formed from plastic, styrene, insulated rubber, vinyl, combinations thereof, and the like.

Further objects and advantages of this invention will be apparent from the following detailed description of a presently preferred embodiment which is illustrated schematically in the accompanying drawings.

BRIEF DESCRIPTION OF THE FIGURES

FIG. 2A is a cross-sectional side view of a cooler container for fitting about a 1.5 liter water bottles.

FIG. 2B is a cross-sectional view of an optional lid ridge connection.

FIG. 2C is a cross-sectional view of another optional screwable/raised ridges lid connection.

FIG. 3B is a cross-sectional side view of a second container for a 1 quart bottle with a drop in.

FIG. 8A is a side cross-sectional view of another cooler container embodiment having a downwardly hanging lever arm handle.

FIG. 8B is a cross-sectional top view of one embodiment of the lever handle of FIG. 8A.

FIG. 8C is a cross-sectional top view of another embodiment of the lever handle of FIG. 8A.

FIG. 8D is a cross-sectional top view of still another embodiment of the lever handle of FIG. 8A.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
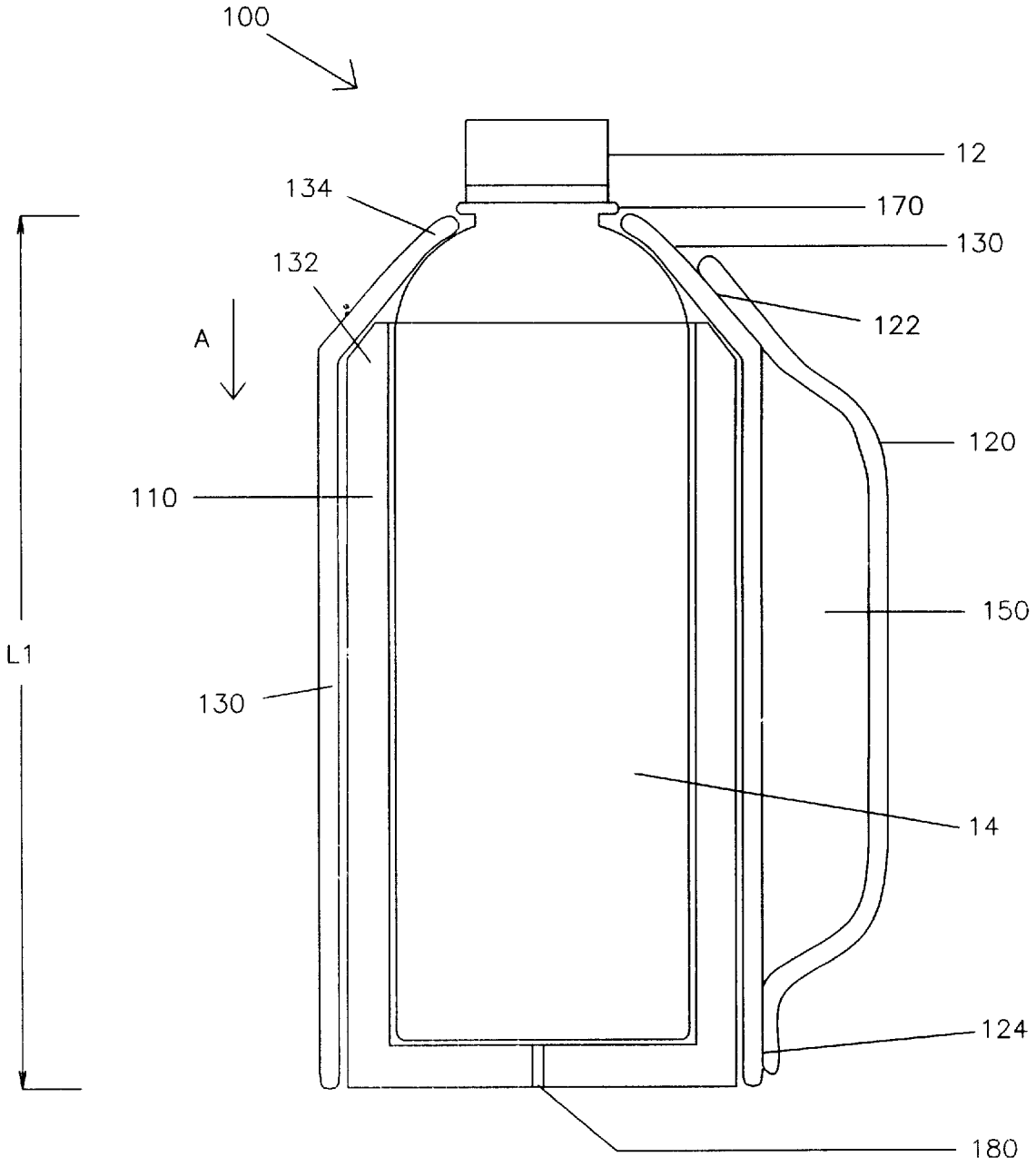
FIG. 1 is a cross-sectional side view of an adjustable cooler container for standard bottles.

FIG. 1 is a cross-sectional side view of an adjustable cooler container 100 for standard bottles. Bottle 14 can be a one liter, 1.5 liter, 1 quart type disposable bottle with a standard screwable lid 12. Embodiment 100 includes a flexible insulated outer cover 130 which slides in the direction of arrow A over bottle 14 having an opening at the top for fitting over the widest of disposable bottles which can be approximately one ⅝ inch in diameter. Cover 130 can be formed of rubber, material such as those used in insulated dive suits and the like. The length, L1, of cover 130 varies according to the dimensions of bottle 14. Inside cover 130 is insert cup sleeve 110 which can be formed from at least one of Styrofoam, urethane foam, double insulated plastic that is hollow therebetween or filled with Blue-Ice solutions. The top of cup 110 has a wedge portion 132 for allowing a better frictional contact between the bottle 14 and cover 130. The bottom of cup 110 is a through-hole 180 which allows for bottles 14 to be more easily inserted therein. Attached to the side of outer cover 130 is a flexible strap 120 which can be stitched at the ends 122, 124 allowing for fingers of a hand to fit through opening 150.

FIG. 2A is a cross-sectional side view of a cooler container 200 for fitting about popular 1.5 liter water bottles 24. Lower cylindrical portion 210 has exterior grooved surface 205 and a curved lower bottom 214 which match those on the exterior of 1.5 liter bottle 24 having exterior grooves 207. An optional through-hole 280 in the side of cylinder 210 allows ease of sliding over the water bottle 24 so that air in the cylinder passes out of through-hole 280 when a bottle 24 is inserted therein. Furthermore, an optional interior molded ring ridge 281 can alternatively be used to tighten the seal between the walls 210 and the bottle 24. A molded side handle includes a raised outer ridge 220 and a solid material portion 222 therebetween the ridge 220 and the side of cylinder 210. The top of cylinder 210 has a raised rib 212 which mateably conforms to an indented portion 232 in cover 230 allowing the cover 230 to snapably attach to the cylinder 210. The top of cover 230 has an opening 234 for allowing the cap 22 of the water bottle 24 to pass through. Bottom cylinder 210 and cover 230 can be formed from injection molded high density plastic foam such as but not limited to styrene and urethane.

FIG. 2B is a cross-sectional view of an optional snapable connection between upper step shaped end 212' and lower mateable lid cover 230' which can be used when the cooler is formed from styrene. FIG. 2C is a cross-sectional view of another optional connection between upper step end with raised or threaded ridges 212" to mateable step cover 230" which can be used when the cooler is formed from plastic.

Figure 3A:
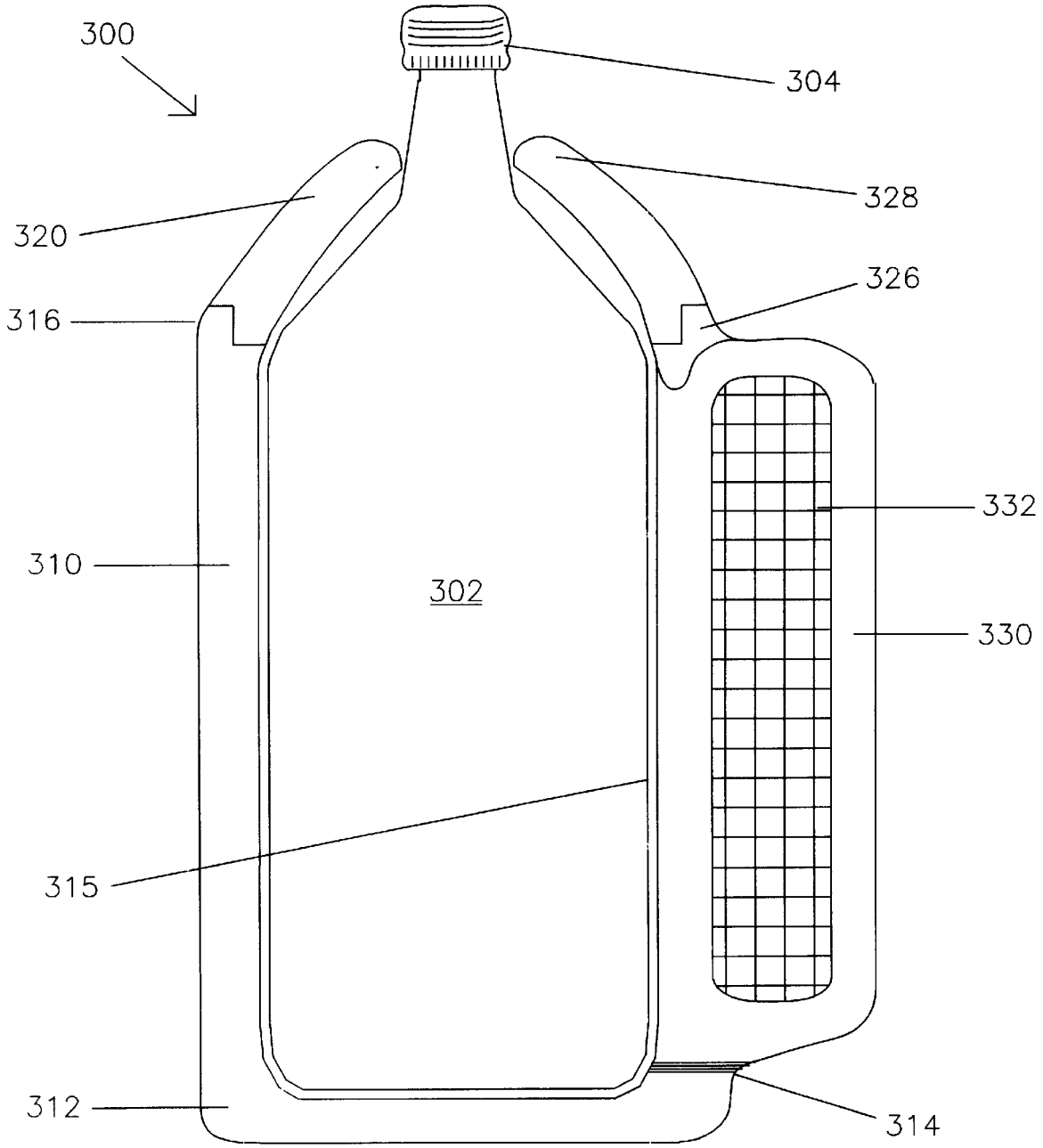
FIG. 3A is a cross-sectional side view of a first cooler container for 1 quart standard bottles.

FIG. 3A is a cross-sectional side view of a cooler container 300 for 1 quart standard bottles 302 such as a quart beer bottle and the like. Container 300 includes lower cylindrical container 310 having a lower bottom 312 adapted to fit about a standard quart bottle 302. An optional approximately ⅛ inch wide through-hole 314 allows for the cylindrical bottom 310 to be inserted about the quart bottle 302. An optional interior raised ridge(s) 315 can run down the interior sides of main cylindrical portion 310. A molded side handle includes a raised outer ridge 330 and a solid material portion 332 therebetween the ridge 330 and the side of cylinder 310. The top of cylinder 310 has a ½ lap or threads 316 which mateably conforms to a portion 326 in cover 320 allowing the cover 320 to snapably attach to the cylinder 310. The top of cover 320 has an opening 328 for allowing the screwable cap 304 of the bottle 302 to pass through. Bottom cylinder 310 and cover 320 can be formed from injection molded high density plastic foam such as but not invited to styrene, and urethane.

Figure 3B:
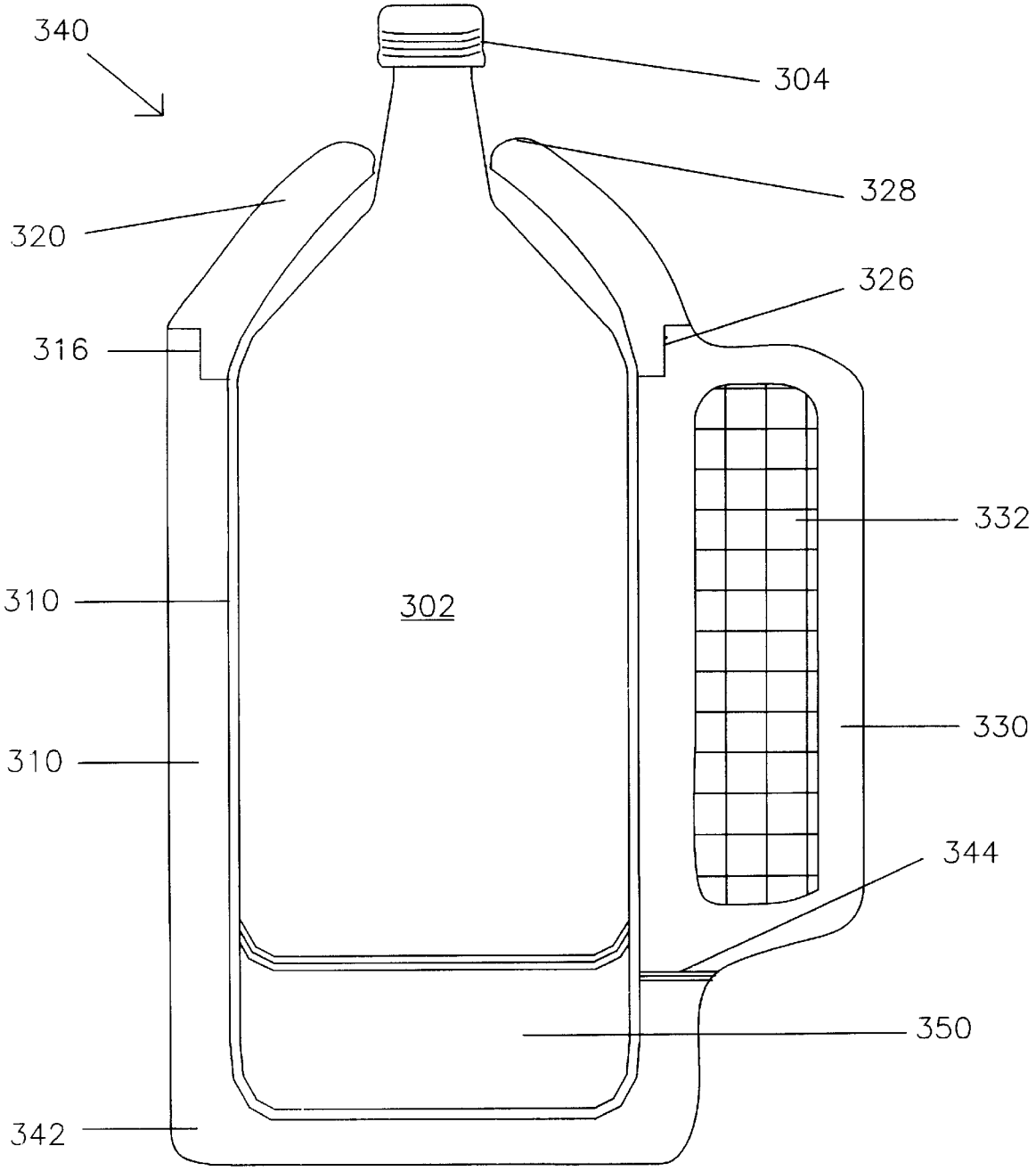

FIG. 3B is a cross-sectional side view of a second cooler container 340 for a 1 quart bottle. The difference over the FIG. 3A container is the larger cylindrical container bottom portion 342 which is a molded part of the main cylindrical portion 310, with a venting through-hole 344 of approximately ⅛ inches in diameter to one side. The inside of bottom portion 342 can house a pre-chilled plastic coolant bag of ice, blue-ice®, and the like.

Figure 3C:
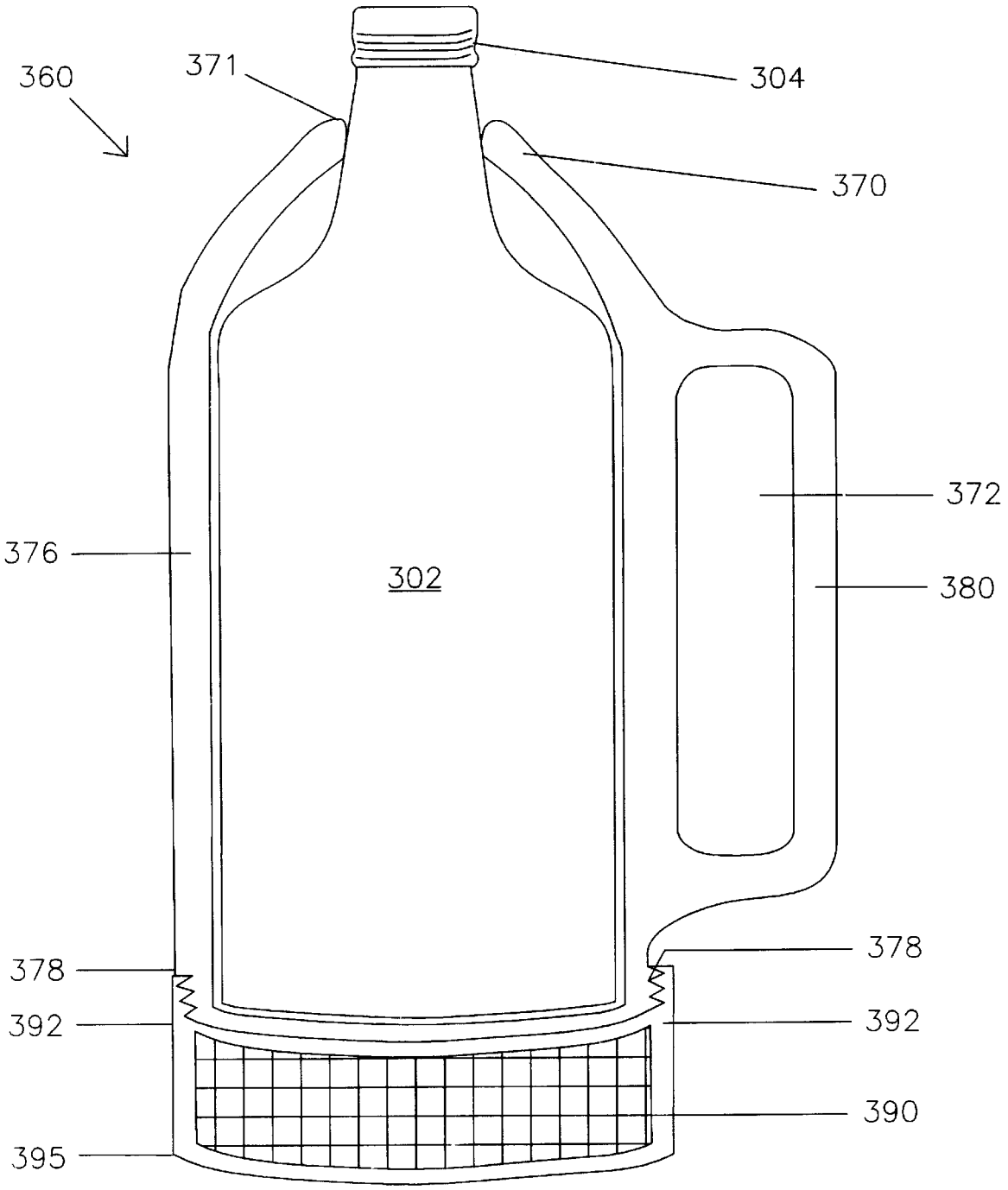
FIG. 3C is a cross-sectional side view of a third cooler container for a 1 quart bottle with a detachable freezable base.

FIG. 3C is a cross-sectional side view of a third cooler container 360 for a 1 quart bottle. In this embodiment, container 360 includes a one piece molded upper portion 376 having an upper opening 371 in the domed top 370 which sized to fit over the top 304 of a 1 quart bottle 302. A molded handle portion 380 curved external to the side of container 376 with an interior portion 372 which can be a through-hole or a solid portion having a smaller thickness than the external handle portion 380 for a better grip. A screwable bottom base 395 having a prechillable ice or blue ice® interior 390 can be attached by threads 392 to mateable threads 378 on container 360. When the pre-frozen base 395 is removed the bottle 302 can be inserted into the container 360. Bottle 302 can be inserted into container 360 and prefrozen base 390 is threaded on to extend the cooling time of bottle 302.

Figure 4:
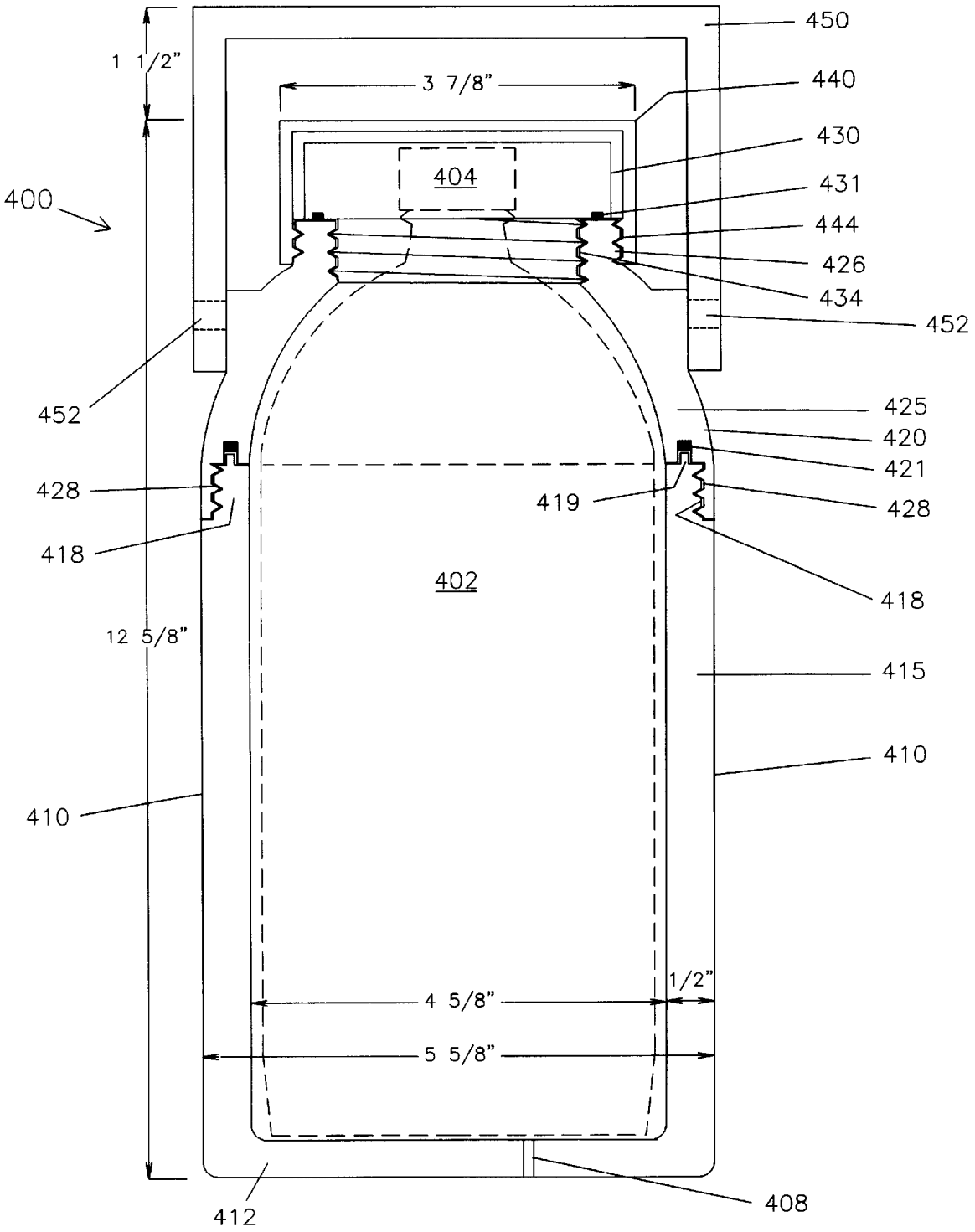
FIG. 4 is a cross-sectional side view of another cooler container for a two liter bottle.

FIG. 4 is a cross-sectional side view of another cooler container 400 for fitting about a standard two liter bottle 402. Embodiment 400 includes a plastic molded cylindrical walls 410 than can be formed of molded high density plastic closed cell foam such as but not limited to Styrofoam, polystyrene, and the like. The interior of the walls can be solid molded plastic. Alternatively, sides 410 can be hollow space 415 between double co-axial interior and exterior walls 410 having a chillable liquid such as ice, and blue ice® therebetween. A base 412 to the cylindrical section 410 can have a through-hole 408 from the interior to the exterior. The top of cylinder 410 has external threads 418 there-around. An upper dome portion 420 of similar plastic molded material has a lower threaded section 428 for mateably being connected to threads 418 of the cylinder section 410. An optional 0-ring 421 such as a rubber gasket fits inside a bottom edge of dome 420 which allows the dome 420 to seal against the cylinder section 410. An upper protruding rim 419 molded onto the top of cylinder walls 410 helps the cylinder 410 seal against dome 420. The rim 419 can optionally be removable allowing the interior hollow space 415 therein to be filled with liquid ice and the like. The upper section of dome 420 has interior threads 424 which can threadably attach to the threads 434 of an optional cap lid 430. An O-ring 431 such as a rubber gasket formed inside the edge of cap lid 430 allows the cap lid 430 to seal against the dome 420. Dome 420 can also be double walled similar to cylinder walls 410 and can include a hollow interior portion 425 which holds ice, blue ice® and the like therein. An optional drinking cup 440 of similar molded plastic construction having internal threads 444 for mateably attachment to exterior threads 426 on dome 420. An exterior handle 450 has vertical legs with a rotating hinge portion 452 which connects and is rotatable relative to a connection point 429 on the exterior portion of dome 420. Handle 450 allows embodiment 400 to be able to be hand carried by users. The interior of embodiment 400 can be sized to fit 1 quart through 1 gallon sized disposable bottles. Furthermore, through-hole 408 can include a plug so that embodiment 400 can be used as a cooler container for holding and keeping cool liquid not within a disposable bottle. Optionally interior ringed ridges or axial running raised ridges such as those previously described can be used.

Figure 5:
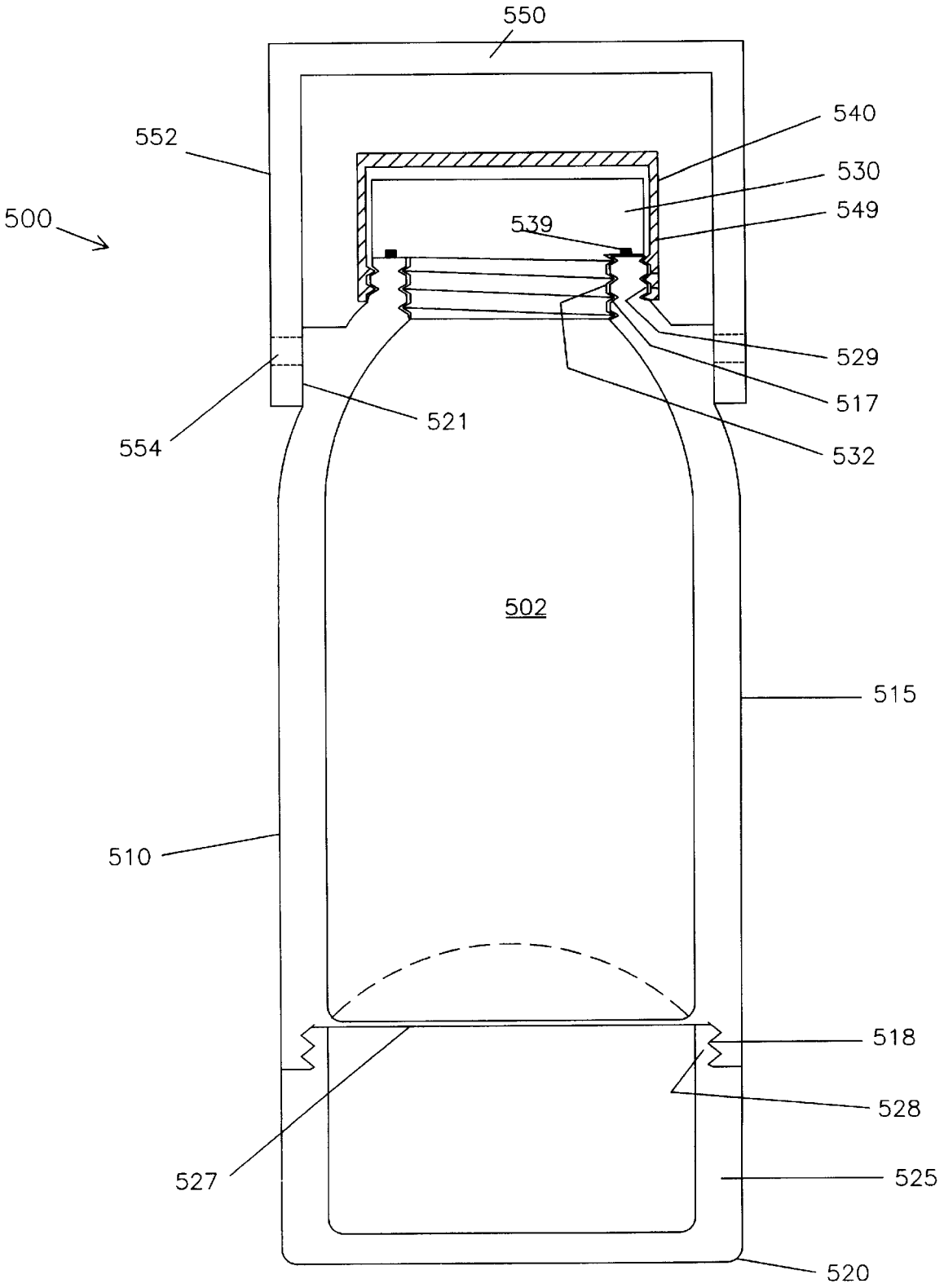
FIG. 5 is a cross-sectional side view of another cooler container with a detachable base for ½ gallon jugs.

FIG. 5 is a cross-sectional side view of another cooler container 500 for use with different sizes of coolers such as but not limited to ½ gallon jugs 502 and the like. A detachable pre-freezable base 520 can be used for multiple sizes of cooler sized containers. Embodiment 500 includes cylindrical side-walls 510 of molded plastic material or double walled with a prechillable liquid 515 therebetween as described previously, threads 518 on a lower portion which mate to threads 528 on the external edge 528 of a lower base portion 520, wherein the base 520 can be solid or double walled with prechillable liquid 525 therebetween similar to the sidewalls 510. Interior 525 can be a plastic disc insert which can be formed of ice, blue ice® and the like. A removable cap lid 530 having threads 532 can screw onto mateable threads 517 in the neck portion of cylinder walls 510, wherein an O-ring 539 such as a rubber gasket attached to a lower edge of the cap lid 530 can cause the cap lid 530 to seal against the neck portion 517 of the cylinder 510. An optional cup cap 540 having interior threads 549 can mateably attach to exterior threads 529 on the neck 517 of cylinder 510. An exterior handle 550 having vertical legs 552 with hinge section 554 which rotates and connects to like hinge portion 521 of cylinder 510.

Figure 6:
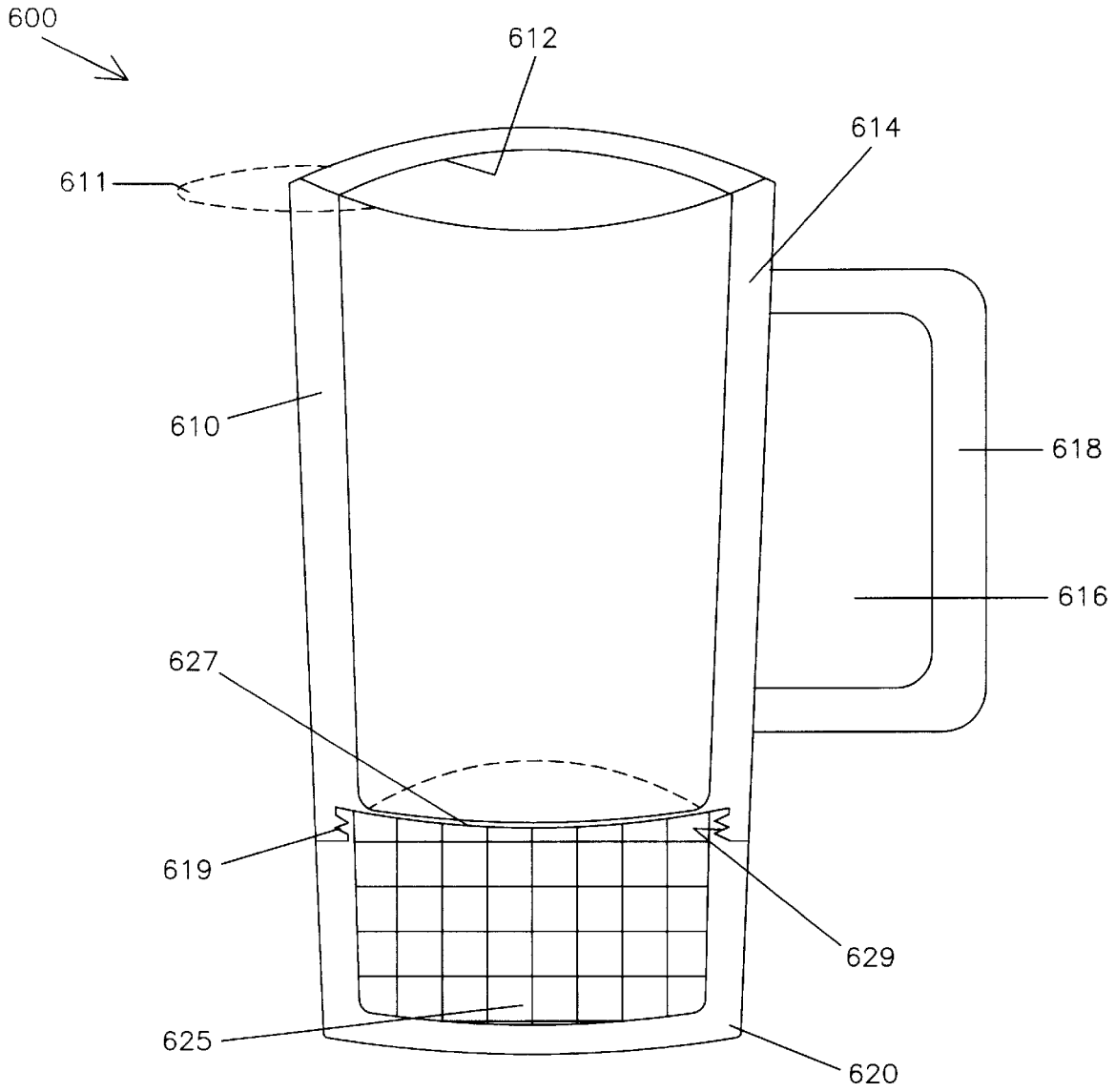
FIG. 6 is a cross-sectional side view of another cooler container for use as a pitcher using a detachable base.

FIG. 6 is a cross-sectional side view of another cooler container 600 for use as a pitcher, or mug, wherein conical side walls 610 having a larger diameter open top 612, a u-shaped side handle 618 is molded to a side, and an opening 616 is inside the handle. Alternatively, handle 618 can have raised thicker exterior edge 618 and a less thick solid interior portion 616. The bottom of conical cylinder 610 can have interior threads 619 which mateably attach to threads 629 on a removable base 620 which can house a removable plastic disc 625 of ice, blue ice® and the like. A snapable disc base 627 can keep the contents of the base 620 from being mixed with the interior contents of the conical pitcher cylinder 610. Furthermore, an optional spout 611 can be molded onto the container 600 to aid in pouring the contents out. Optional lid covers, not shown, that are snapable and screwable such as those previously described can be used this pitcher and mug embodiment.

Figure 7B:
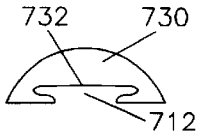
FIG. 7B is a side view of the slidable lid portion of FIG. 7A along arrow A, that keeps the bottle in the pitcher.
Figure 7A:
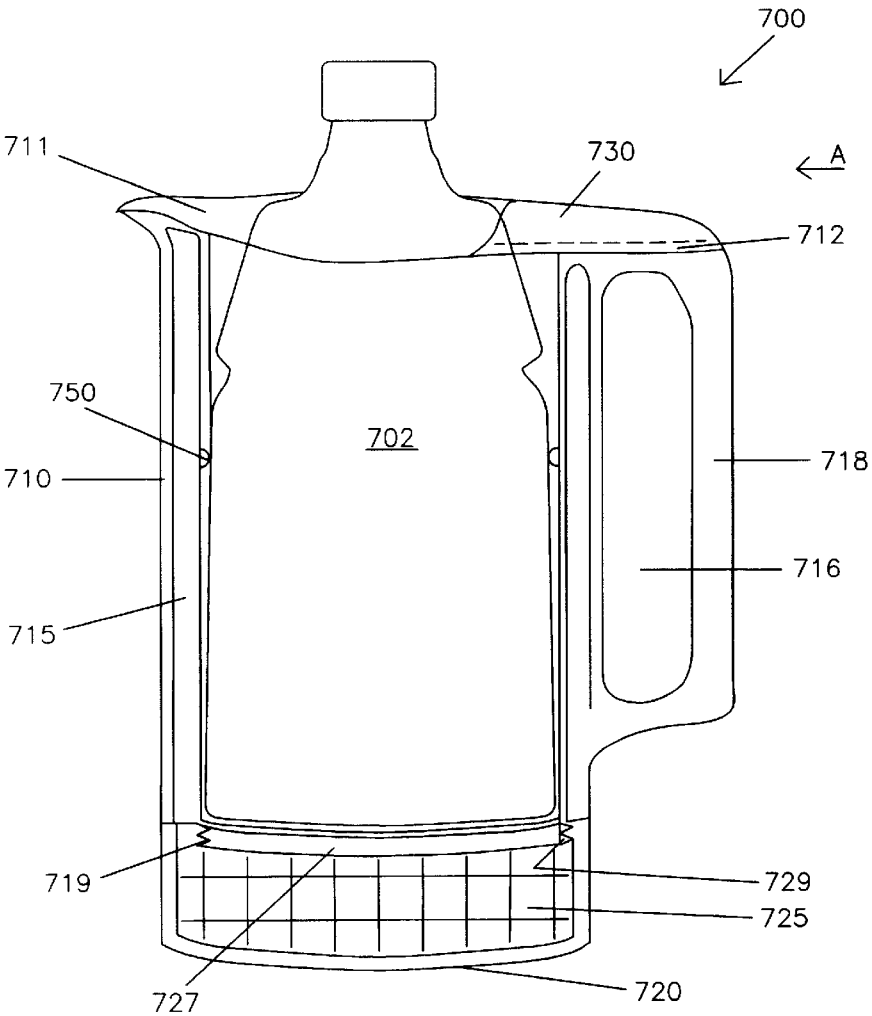
FIG. 7A is a cross-sectional side view of another cooler container for use holding a sport bottle therein and for being used as a pitcher that can be used with or without a detachable base.
Figure 7C:
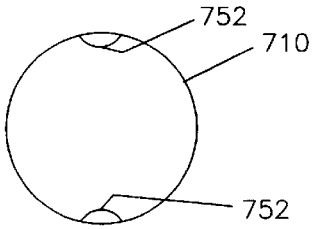
FIG. 7C is a top view of axial running raised beads for securing bottles within the pitcher.

FIG. 7A is a cross-sectional side view of another cooler container 700 for use holding a sport bottle 702 therein and for being used as a pitcher. FIG. 7B is a side view of the slidable lid portion 730 of FIG. 7A along arrow A. Referring to FIGS. 7A–7B, container 700 includes side cylindrical walls 710 of solid molded plastic or being doubled co-axial walls with a hollow space 715 therein for ice, blue ice® and the like. A side handle 718 molded to the side walls 710 can have an opening or a less thick plastic area 716 therebetween. Threads 719 on the lower portion of cylinder 710 mate to threads 729 of a removable base 720 which can have a removable plastic disc 725 of ice, blue ice® and the like. A snapable lid 727 can separate the contents of the base 720 from the interior of the cylinder walls 710. A angled pouring lip 711 on one upper edge of the cylinder walls 710 allows the container to be used as a pouring pitcher. A sliding lid 730 having a lower T-shaped groove 732 for sliding over a raised T-protrusion 712 on the cylinder 710. Optionally raised interior ringed ridge(s) 750 can be used to help secure bottle(s) 702 within. FIG. 7C is a top view showing optional interior facing axial raised molded beads 752 for helping secure bottles 702 within the pitcher 710.

FIG. 8A is a side cross-sectional view of another cooler container embodiment 800 having a downwardly hanging lever arm handle 835. Similar to the other embodiments, a cover lid 820 has ½ lap or threaded edges 821 which mate to edges 817 of main cylindrical body 810. Main body 810 has a diameter with a slight taper from the top 816 to the bottom wall 812 for tightly supporting disposable bottles such as but not limited to a two liter bottle 802 inside. Similar to the previous embodiments, an optional through-hole 814 can be the main body 810. Alternatively, optional interior facing raised ringed ridges 811, or longitudinal beads can be used. A separate band 830 can be wrapped about an upper portion of main body 810 just beneath raised lip 816. Attached to one side of band 830 is a downwardly running plastic lever arm handle 835.

FIG. 8B is a cross-sectional top view of one embodiment of the lever handle 835' of FIG. 8A having a circular cross-section. FIG. 8C is a cross-sectional top view of another embodiment of the lever handle 835" of FIG. 8A having a U-shaped cross-section. FIG. 8D is a cross-sectional top view of still another embodiment of the lever handle 835"' of FIG. 8A having an H-shaped cross-section. Similar to the previous embodiments, embodiment 800 can be formed material such as plastic, styrene, urethane and optionally include pre-freezable liquid layers and the like.

Figure 9:
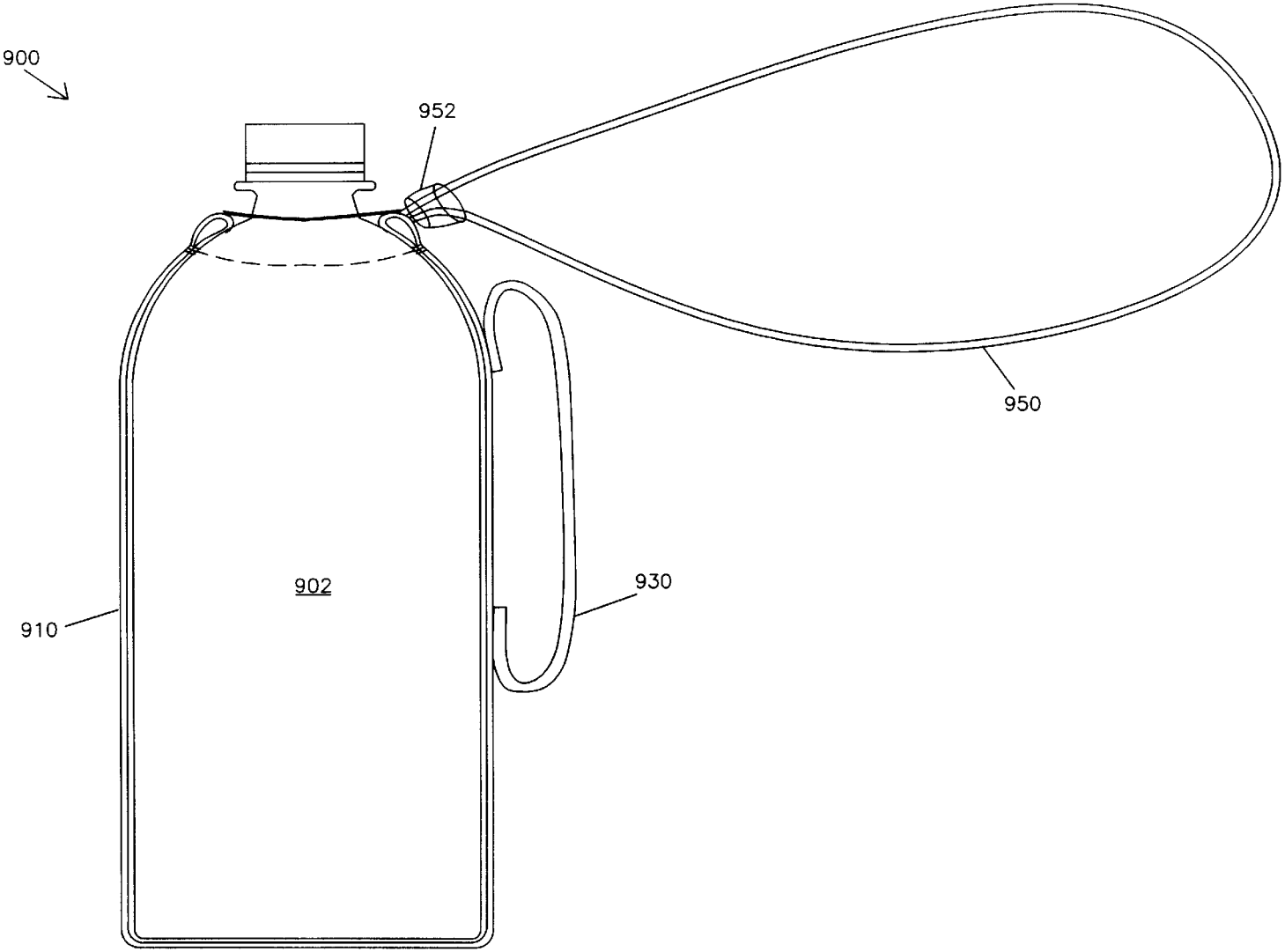
FIG. 9 is a side cross-sectional view of another cooler container having a lanyard handle.

FIG. 9 is a side cross-sectional view of another cooler container 900 having a lanyard string 950 attached with a movable clip 952 to the neck of a container 910 holding a disposable bottle 902 therein. Container 910 can be any of the previously described cooler containers.

Figure 10:
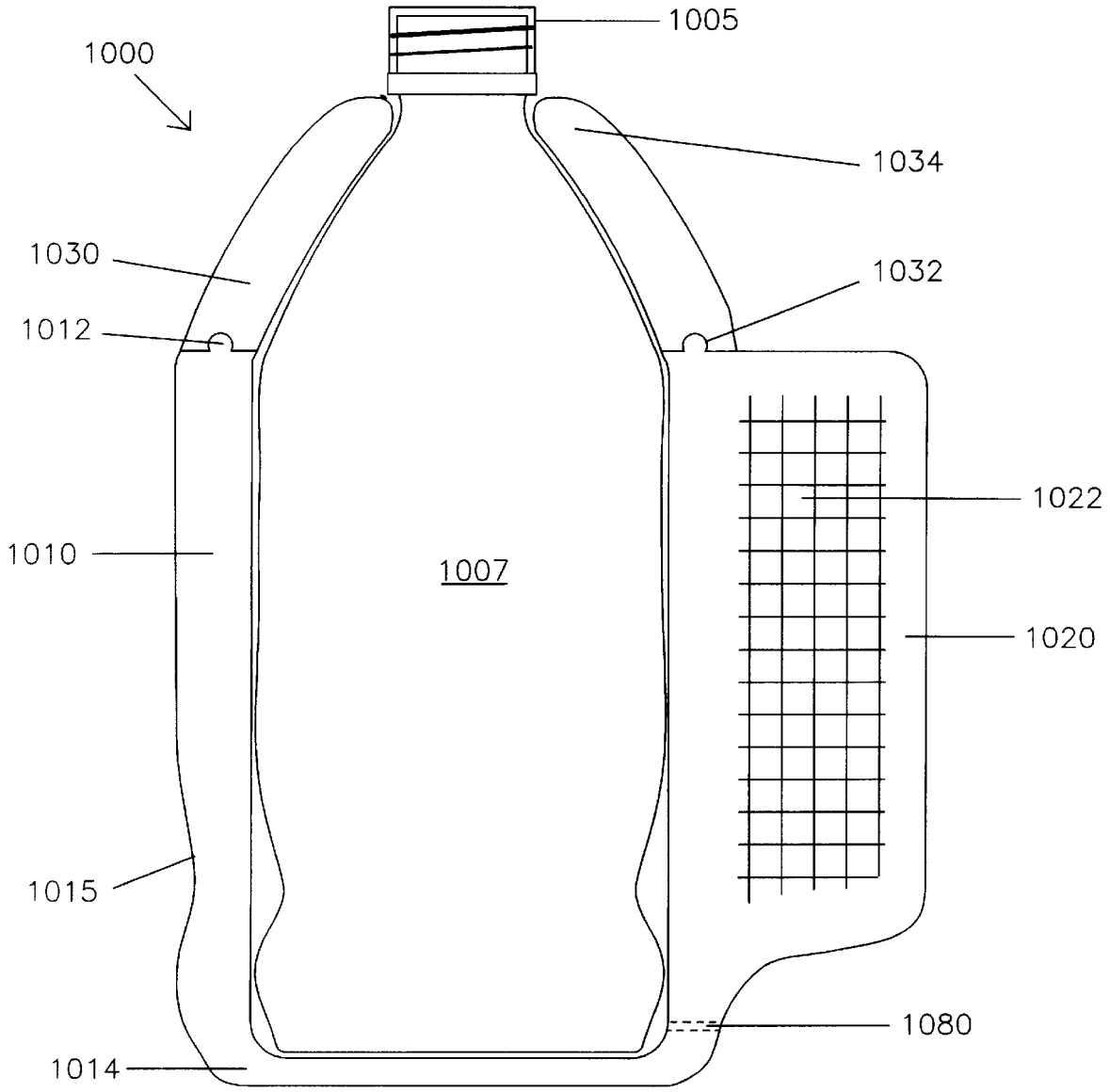
FIG. 10 is a side cross-sectional view of another cooler container for use with designer bottles.

FIG. 10 is a side cross-sectional view of another cooler container having a cooler container that directly screws onto the existing cap threads of disposable bottles.

FIG. 10 is a side cross-sectional view of another cooler container 1000 for use with designer type bottles 1007 such as a curved Coke® disposable bottle 1007 and the like. Components 1030, 1034, 1010, 1014 and 1080 are similar to those previously described. The outer surface of main body 1010 has a concave shaped curved section wrapping about the mid-portion thereof matching that of the Coke® bottle 1007 inside. Similar to the previous embodiments, connection 1012 can a ½ lap, snappable groove or screwable Handle has a raised wider outer perimeter 1020 and less material inside 1022 and is part of the same mold as that of the main body. Optional interior raised beads, rings can be used such as those previously described. Furthermore, the downardly angled lever handle such as that previously described can be substituted thereon.

Figure 11A:
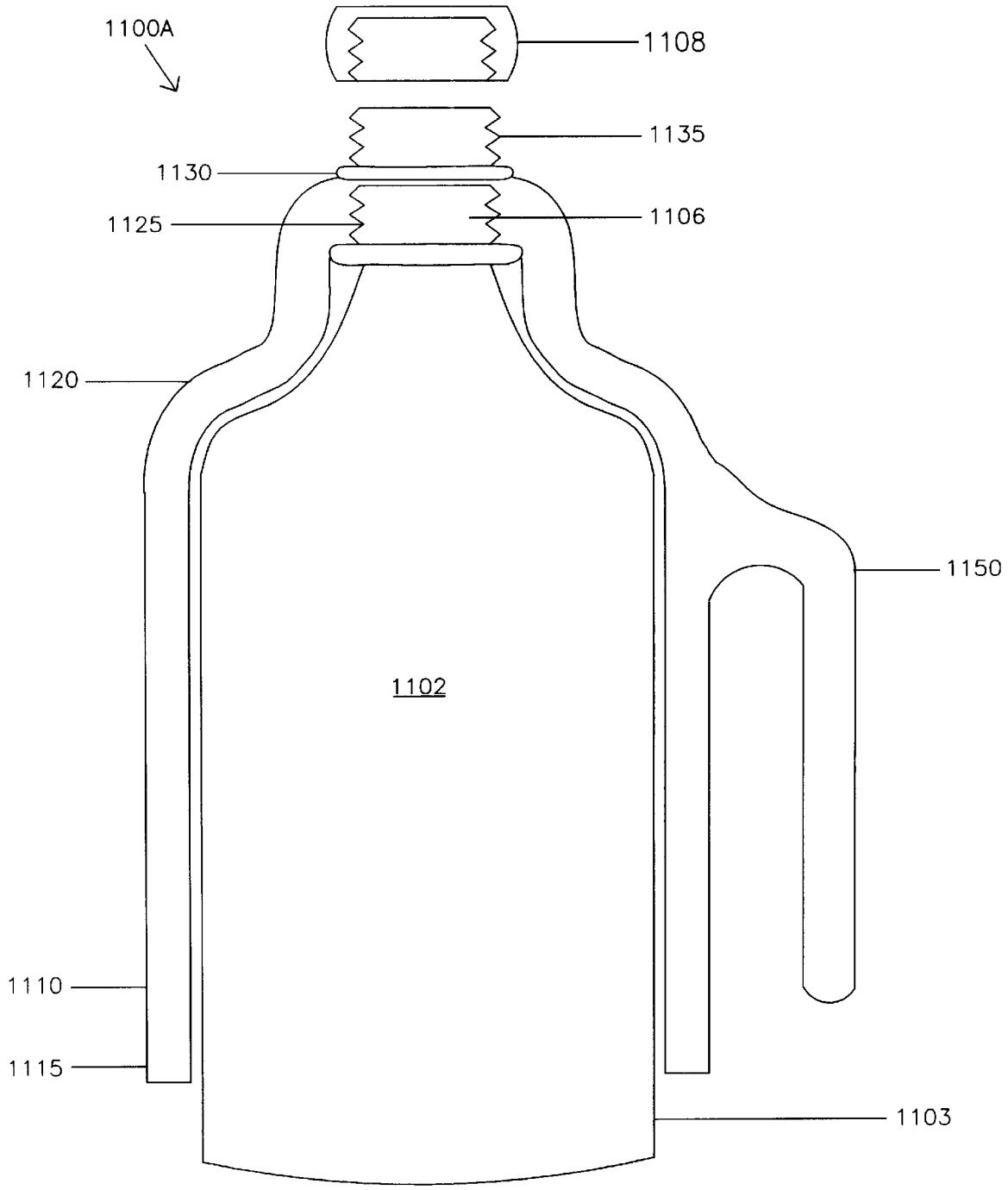
FIG. 11A is a side cross-sectional view of a screwable skirt cooler container that directly screws onto the existing cap threads of disposable bottles.

FIG. 11A is a side cross-sectional view of first version 1100A of a screwable cylindrical insulated cooler container body 1110 that directly screws onto the existing cap threads 1106 of a disposable bottle 1102. Cylindrical slip cover 1110 has an open bottom end 1115 and a narrower neck portion 1120 with internal facing threads 1125 which mateably screw about the existing external threads 1106 of a disposable bottle 1102. An optional raised neck ring 1130 can be used to allow a user to grip the cooler 1100 with bottle 1102 therein. External threads 1135 are on the top upper outer portion of the neck portion 1120 and can mate to the existing threads within a screwable cap 1108 which generally comes with the disposable bottle 1102. The interior dimensions of the slip cover 1110 can be similar to the outer diameter of a three liter disposable bottle so that the same slip cover 1110 can be used for two liter, one liter, quart and other size disposable bottles. A user can hold the bottom portion 1103 of the disposable bottle in order to screw the threads of the disposable bottle 1106 onto the threads 1125 of the embodiment 1100. An optional downwardly angled lever arm handle 1150 can be part of the molded cylindrical main body slip cover 1110 to allow a user to better grip the embodiment 1100. Slip cover cylindrical walls 1110 can be formed from insulated material such as but not limited to plastic, styrene and urethane. Alternatively, the walls 1110 can be layered with a pre-freezable liquid therein as is previously described in the previous embodiments.

Figure 11B:
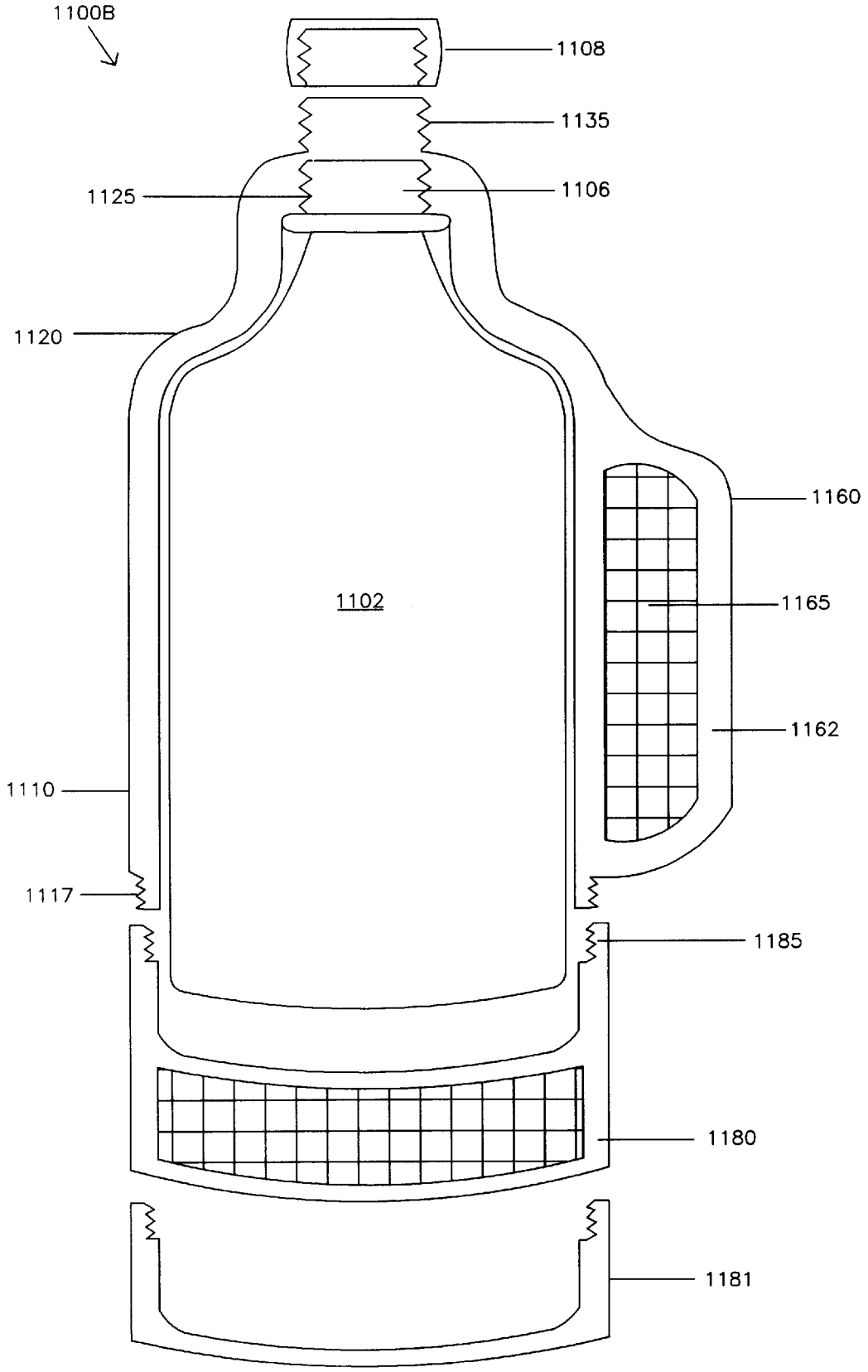
FIG. 11B is a side cross-sectional view of the screwable skirt cooler container of FIG. 11 A with an attachable pre-freezable base.

FIG. 11B is a side cross-sectional view 1100B of the screwable skirt cooler container 1100 of FIG. 11A with an attachable pre-freezable base 1180 that has internal threads 1185 that mateably screw onto external threads 1117 on the bottom outer edge of slip cover 1110. Base 1180 can have a pre-freezable liquid such as but not limited to blue-ice®, water and the like. An optional molded on handle 1160 having a raised thickened outer perimeter 1162 and an indented interior portion 1165 can be used to better enable a user to grip the slip cover 1200.

Figure 11C:
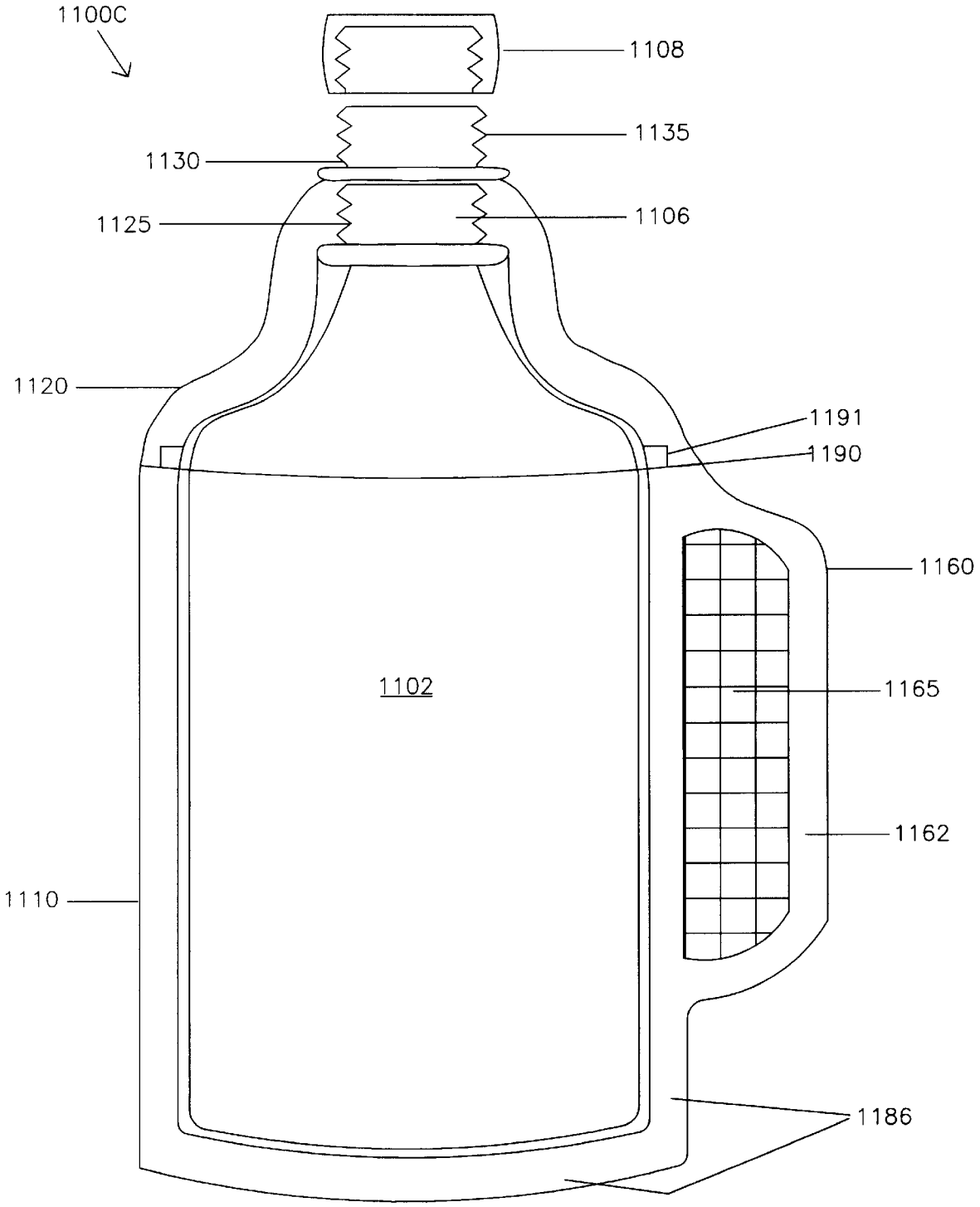
FIG. 11C is a side cross-sectional view of the screwable skirt cooler container of FIG. 11A having a detachable top cover.

FIG. 11C is a side cross-sectional view an another version 1100C of the screwable skirt cooler container of FIG. 11A having a detachable top cover 1120 that is detachable at snapable portions 1190, 1191. Alternatively, connections 1190 and 1191 can be mateable threads that interlock one another as described in previous embodiments. The bottom of slip cover 1100 can be a completely closed bottom base 1186.

Figure 11D:
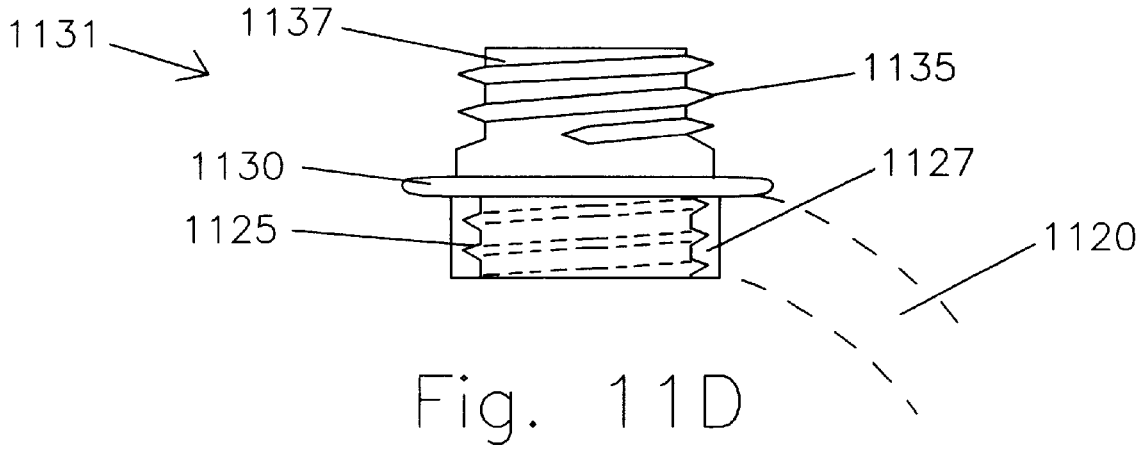
FIG. 11D is an enlarged view of the top coupler portion of the sleeve cover of FIGS. 11A–11C.

FIG. 11D is an enlarged view of the top coupler portion 1131 of the sleeve cover of FIGS. 11A–11C. The narrowing neck portion 1120 has internal facing threads 1125 of hollow lower neck 1127 mateably screw about the existing external threads 1106 of a disposable bottle 1102(shown in the preceding Figures). Optional raised neck ring 1130 can be used to allow a user to grip the entire cooler. External threads 1135 about hollow upper neck 1137 can mate to the existing internal threads within a typical screwable cap 1108 comes with the disposable bottle. The materials forming the top coupler portion can be plastic, styrene, and the like. With the novel top coupler 1131, the slip cover 1120 shown in FIGS. 11A can be formed from various materials such as but not limited to plastic, styrene, with insulating interior layers. Alternatively, the sleeve 1120 can be formed from insulating rubber and vinyl covered materials and the like, with connect by glue adhesives and/or sewn to the plastic type coupler portion 1131.

Figure 12B:
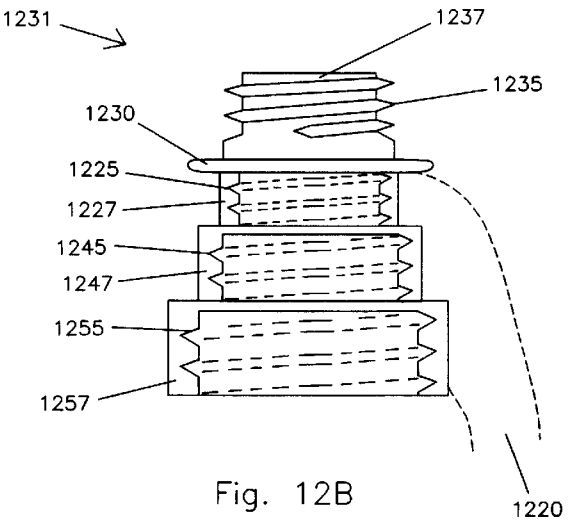
FIG. 12B is an enlarged view of the multi-cap coupler of FIG. 12A.
Figure 12A:
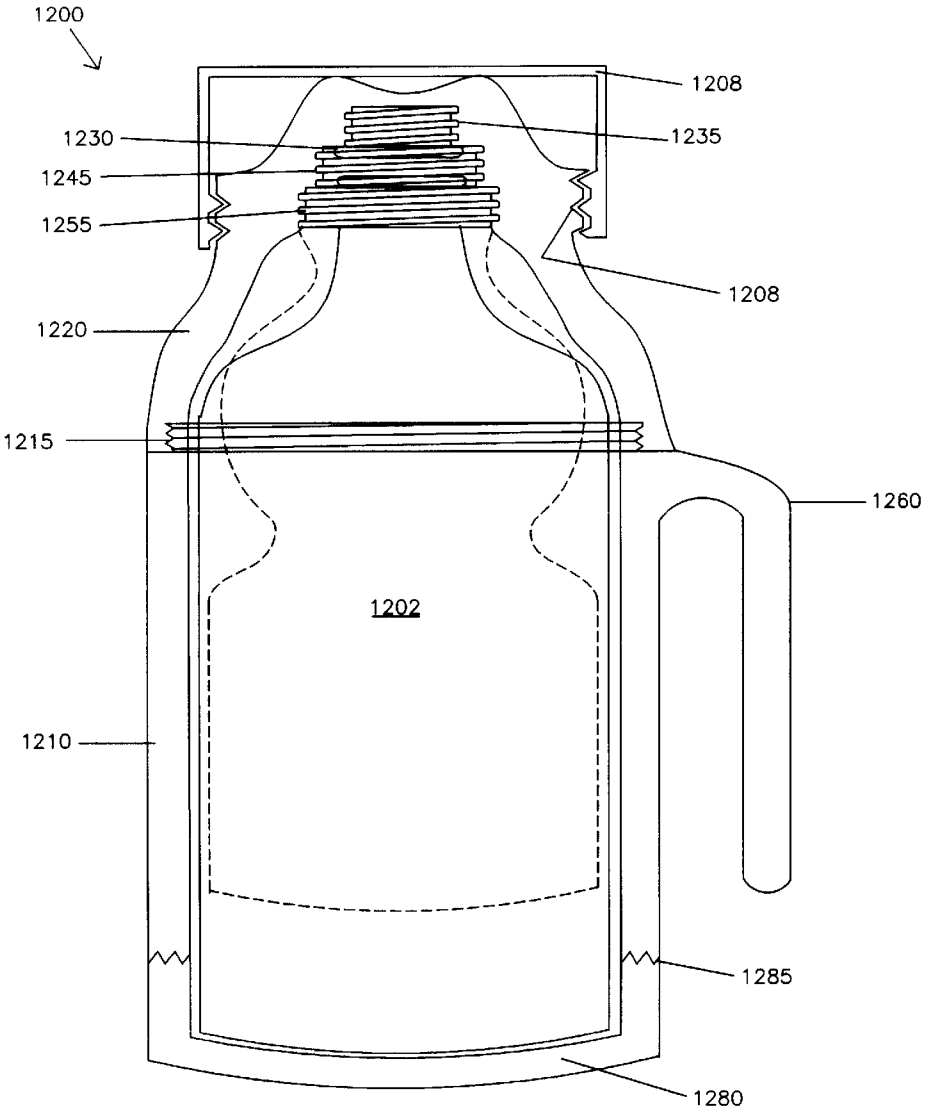
FIG. 12A is a side cross-sectional view of a screwable insulated skirt cooler with multi-cap coupler.

FIG. 12A is a side cross-sectional view of a screwable insulated skirt cooler 1200 with multi-cap coupler 1231. FIG. 12B is an enlarged view of the multi-cap coupler 1231 of FIG. 12A. referring to FIGS. 12A–12B, multi-cap coupler 1231 includes top external threads 1235 about top hollow neck 1237 for receiving the internal threads of a disposable bottle cap 1208. Top hollow neck can have a diameter of approximately 1&⅕" and a height of approximately ⅗". Optional raised ring 1230 allows a user to grip cooler 1200. First lower neck 1227 includes internal threads that mateably screw about the existing external threads 1206 of a disposable bottle 1202. First lower neck 1227 can be similar in dimensions to top hollow neck and have a diameter of approximately 1&⅕", and a height of approximately ⅗". Disposable bottle 1202 can include but is not limited to an eight ounce, 12 ounce, 16 ounce, 20 ounce, one liter, or two liter bottle or three-litter bottle previously described. Second lower neck 1247 includes internal threads 1245 which can mateably screw about the existing exterior threads of a different neck bottle such as a one liter wide mouth PEPSI® bottle, and have dimensions of approximately 1&½" and a height of approximately ⅗". Third lower neck 1257 includes internal threads 1255 which can mateably screw about the existing exterior threads 1208 of a 32 ounce, a 64 ounce sport bottle such as GATORADE®, POWERAIDE®, and the like. Third lower neck can have a diameter of approximately 1&⅘" and a height of approximately ½". Handle 1260 can be a lever arm or similar to one of the handles previously described. Cover-lid 1220 can detach from sleeve

1210 by a connectors 1215 such as mateable threads previously described, and base 1280 can be detachable from sleeve 1210 by connectors such as mateable threads that were previously described. The multi-cap coupler 1231 and remaining sleeve cover components 1220, 1210, 1260, 1280 can be a preformed from plastic, styrene, and the like. Alternatively sleeve cover components 1220, 1210, 1260, 1280 can be formed from insulated rubber, vinyl, combinations thereof, and the like, and be fastened, adhered or connected to multi-cap coupler 1231 by glue, sewn stitches and the like.

Figure 13A:
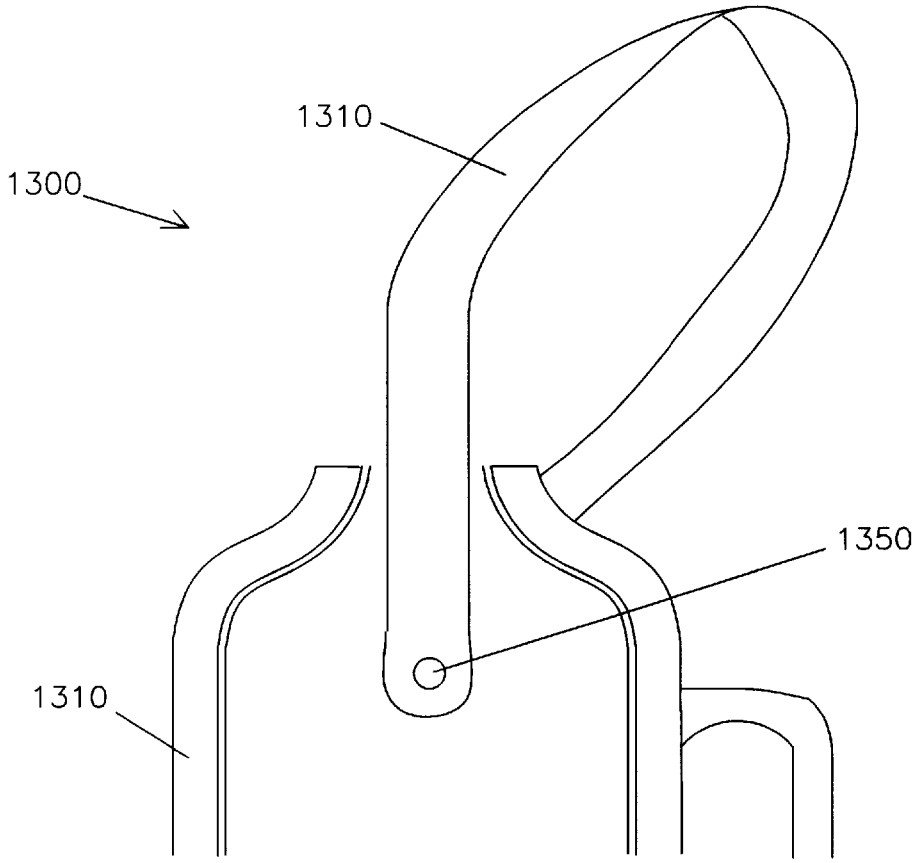
FIG. 13A shows the optional strap attachment that can be used with the embodiments of the previous figures.
Figure 13B:
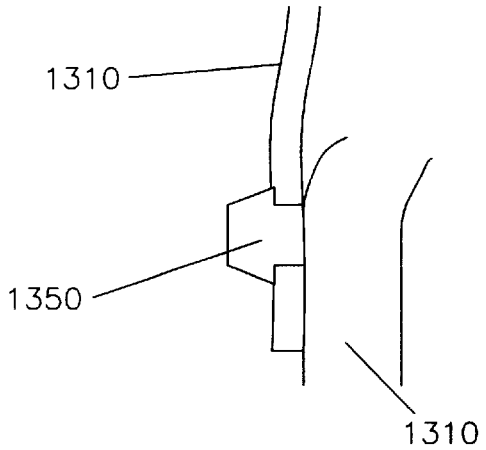
FIG. 13B is an enlarged side cross-sectional view of the strap and cooler connection of FIG. 13A.

FIG. 13A shows the optional strap attachment 1310 that can be used with the embodiments of the previous figures. FIG. 13B shows an enlarged side cross-sectional view of the strap 1310 and cooler connection of FIG. 13A. Strap 1310 can be flexible material such as but not limited to plastic, cloth, leather, and the like, and be fastened to cooler sleeve 1310 by a grommet 1350, which can be plastic, metal, and the like. Cooler sleeve 1310 can be any of the previous cooler sleeves described in the subject invention.

Although the embodiments have been described has having single type interior raised ridges inside the main cylindrical portions, plural interior ringed ridges, or plural axial running raised ridges of varying thicknesses can be used so that one cooler can slip about varying diameter bottles which are based on different manufacturer sizes.

Although the invention has been described for holding and supporting 1, 2 and 3 liter bottles, the invention would be applicable to holding, supporting and providing insulation for other types of bottles such as but not limited to 12 ounce, 16 ounce, quart, half-gallon and gallon containers.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An insulated slip cover for screwably attaching to disposable bottles, comprising:

a hollow insulated sleeve having a narrow neck, and a cylindrical lower portion;

an interior cap having interior facing threads within the neck for mateably screwing onto existing exterior threads of a disposable bottle, wherein attaching the sleeve to the disposable bottle keeps the contents of the disposable bottle at a substantially constant temperature;

exterior facing threads on the neck for mateably attaching to internal threads on a screwable cap from the disposable bottle; and an external raised ring about the exterior face of the neck beneath the exterior facing threads, the raised ring allowing a user to hold the insulated slip cover and bottle together.

2. The insulated slip cover of claim 1, further comprising:

a detachable base for closing an open bottom end of the cylindrical lower portion.

3. The insulated slip cover of claim 1, further comprising:

a downwardly angled lever arm handle attached to a side of the slip cover, for allowing a user to grip the insulated slip cover and the bottle together.

4. The insulated slip cover of claim 1, further comprising:

a side handle attached to a side of the slip cover, for allowing a user to grip the insulated slip cover and bottle together.

5. The insulated slip cover of claim 1, further comprising:

a lanyard attached to the slip cover.

6. The insulated slip cover of claim 1, further comprising:

a second interior cap having second internal threads located inside the neck for allowing the threads on a second disposable bottle to be mateably screwed thereon, where the second disposable bottle exterior threads have a larger diameter than the first disposable bottle exterior threads.

7. The insulated slip cover of claim 6, further comprising:

a third exterior cap having third internal threads located inside the neck for allowing threads on a third disposable bottle to be mateably screwed thereon, where the third disposable bottle exterior threads have a larger diameter than the second disposable bottle exterior threads.

8. An insulated slip cover for screwably attaching to disposable bottles, comprising:

a hollow insulated sleeve having a narrow neck, and a cylindrical lower portion;

an interior cap having interior facing threads within the neck for mateably screwing onto existing exterior threads of a disposable bottle, wherein attaching the sleeve to the disposable bottle keeps the contents of the disposable bottle at a substantially constant temperature; and an external raised ring about the exterior face of the neck beneath the exterior facing threads, the raised ring allowing a user to hold the insulated slip cover and bottle together.

9. An insulated slip cover for screwably attaching to disposable bottles, comprising:

a hollow insulated sleeve having a narrow neck, and a cylindrical lower portion;

a first interior cap having interior facing threads within the neck for mateably screwing onto existing exterior threads of a first disposable bottle, wherein attaching the sleeve to the disposable bottle keeps the contents of the disposable bottle at a substantially constant temperature;

a second interior cap having second internal threads located inside the neck for allowing the threads on a second disposable bottle to be mateably screwed thereon, where the second disposable bottle exterior threads have a larger diameter than the first disposable bottle exterior threads; and a third exterior cap having third internal threads located inside the neck for allowing threads on a third disposable bottle to be mateably screwed thereon, where the third disposable bottle exterior threads have a larger diameter than the second disposable bottle exterior threads.

10. The insulated slip cover of claim 9, further comprising: a side handle attached to a side of the slip cover, for allowing a user to grip the insulated slip cover and bottle together.

* * * * *